US011413515B2

(12) United States Patent
Garcia

(10) Patent No.: US 11,413,515 B2
(45) Date of Patent: Aug. 16, 2022

(54) ALIGNMENT TOOL

(71) Applicant: GOLFNOTCH, LLC, Miami, FL (US)

(72) Inventor: Angel Garcia, Miami, FL (US)

(73) Assignee: GOLFNOTCH, LLC, Miami, FL (US)

( * ) Notice: Subject to any disclaimer, the term of this patent is extended or adjusted under 35 U.S.C. 154(b) by 0 days.

(21) Appl. No.: 17/316,807

(22) Filed: May 11, 2021

(65) Prior Publication Data

US 2021/0362026 A1 Nov. 25, 2021

Related U.S. Application Data

(60) Provisional application No. 63/027,809, filed on May 20, 2020.

(51) Int. Cl.
*A63B 69/36* (2006.01)

(52) U.S. Cl.
CPC ..... *A63B 69/3621* (2020.08); *A63B 69/3676* (2013.01)

(58) Field of Classification Search
CPC ..... A63B 69/3621; A63B 69/3676
USPC ..... 473/257, 261–268, 278, 279
See application file for complete search history.

(56) References Cited

U.S. PATENT DOCUMENTS

| | | | | |
|---|---|---|---|---|
| 6,019,685 | A * | 2/2000 | Fonseca | A63B 69/36211 473/265 |
| 6,443,852 | B1 * | 9/2002 | Kim | A63B 69/3676 473/265 |
| 6,709,343 | B1 * | 3/2004 | O'Connor | A63B 69/3676 473/265 |
| 6,840,870 | B1 * | 1/2005 | Froggatte | A63B 24/0003 473/265 |
| 7,666,107 | B2 * | 2/2010 | Sorenson | A63B 69/3676 473/256 |
| 2002/0016213 | A1 | 2/2002 | Templeton | |

OTHER PUBLICATIONS www.scottycameron.com webpage printed on Mar. 10, 2022 (https://www.scottycameron.com/news/?t=Golf%20Gallery.

* cited by examiner

*Primary Examiner* — Nini F Legesse
(74) *Attorney, Agent, or Firm* — Trueba & Suarez, PLLC; Roberto M. Suarez

(57) ABSTRACT

A practice alignment tool to align a golf ball and putter during practice. The alignment tool is useful for creating a repeatable/consistent aligned squared swing with all golf clubs. A preferred embodiment of the alignment tool has a substantially "L" shaped profile as well as strategically placed tee holes, notches, and markings that allow a golfer to align a golf shot to better hit a target during practice.

3 Claims, 12 Drawing Sheets

ALIGNMENT TOOL

CROSS-REFERENCE TO RELATED APPLICATIONS

This application is a non-provisional of, and claims priority to, U.S. Provisional Patent Application No. 63/027,809, filed on May 20, 2020, titled "Alignment Tool," which is incorporated herein in its entirety.

FIELD OF THE INVENTION

This invention relates generally to an alignment tool and more particularly, to an original apparatus and related method for aligning a golf shot.

BACKGROUND OF THE INVENTION

Whether golf is played professionally or for pure enjoyment, excelling at golf requires a lot of practice and instruction. It is quite common now for golfers to have their swings recorded for later analysis. Time spent on the golf course, plus time spent analyzing a golf swing is often in short supply; therefore golfers look for ways to maximize their practice to achieve their best performance. There is a need for a tool to help golfers improve their swing by improving the quality of their practice and swing analysis.

SUMMARY

Briefly, according to an embodiment of the invention as shown in FIGS. 1-4, an alignment tool 100 has a substantially L-shaped protrusion 101 having a first leg 102 with a first thickness 103, a front 104, and a back 105, and a second leg 106 with a second thickness 107, a top 108, and a bottom 109 (while the bottom 109 is not visible in the figures, it is inherently present due to second leg 106 having a second thickness 107 in relation to top 108). The protrusion 101 has a proximal end 110, a distal end 111 disposed at a length 8 from the proximal end 110, and a center 112 disposed at a distance approximately halfway between the distal end 111 and the proximal end 110. The second leg 106 is substantially orthogonal to the first leg 102. A first edge 113 on the first leg 102 extends between the proximal end 110 and the distal end 111, disposed opposite the second leg 106. A second edge 114 on the second leg 106 extends between the proximal end 110 and the distal end 111, disposed opposite the first leg 102.

The alignment tool 100 has multiple markings as follows. A first centerline marking 5 is disposed on the back 105 of the first leg 102, at the center M of the protrusion 101, and perpendicular to the second leg 106. A proximal alignment marking 115 is disposed on the back 105 of the first leg 102, between the first centerline marking 5 and the proximal end 110, and parallel to the first centerline marking 5. A distal alignment marking 116 is disposed on the back of the first leg, between the first centerline marking 5 and the distal end 111, and parallel to the first centerline marking 5. A second centerline marking 4 is disposed on the top 108 of the second leg 106, at the center 112 of the protrusion 101, and perpendicular to the first leg 102.

Evenly-spaced holes placed throughout the second leg allow for the fitting of tees to anchor the alignment tool. A first hole 2 is disposed on the top of the second leg 106 between the second centerline marking 4 and the proximal end 110. A second hole 2' is disposed on the top 108 of the second leg 106 between the second centerline marking 4 and the distal end 111. Notches on the second leg 106 allow for strategic placement of tees. At least one notch 3 is disposed between the second centerline marking 4 and the proximal end 110 and opens towards the second edge 114. At least one notch 3 is disposed between the second centerline marking 4 and the distal end 111 and opens toward the second edge 114. In one embodiment, a semi-circular notch 117 through the second leg 106 is centered with the second centerline marking 4 and opens toward the second edge 114. According to an embodiment of the invention, the first leg includes space for a logo, shown in FIG. 1 as area 7.

BRIEF DESCRIPTION OF THE DRAWINGS

These and other features, aspects, and advantages of the present invention will become better understood with regard to the following description, appended claims, and accompanying drawings where:

DESCRIPTION

We discuss a practice alignment tool useful for creating a precise alignment of one or more disconnected elements with respect to a desired datum. In a preferred embodiment, and to illustrate one non-limiting use environment, the apparatus is described here as a tool to align a golf ball and putter during practice. The golf practice alignment tool allows golfers to create a repeatable/consistent aligned squared swing with all golf clubs.

Figure 29:
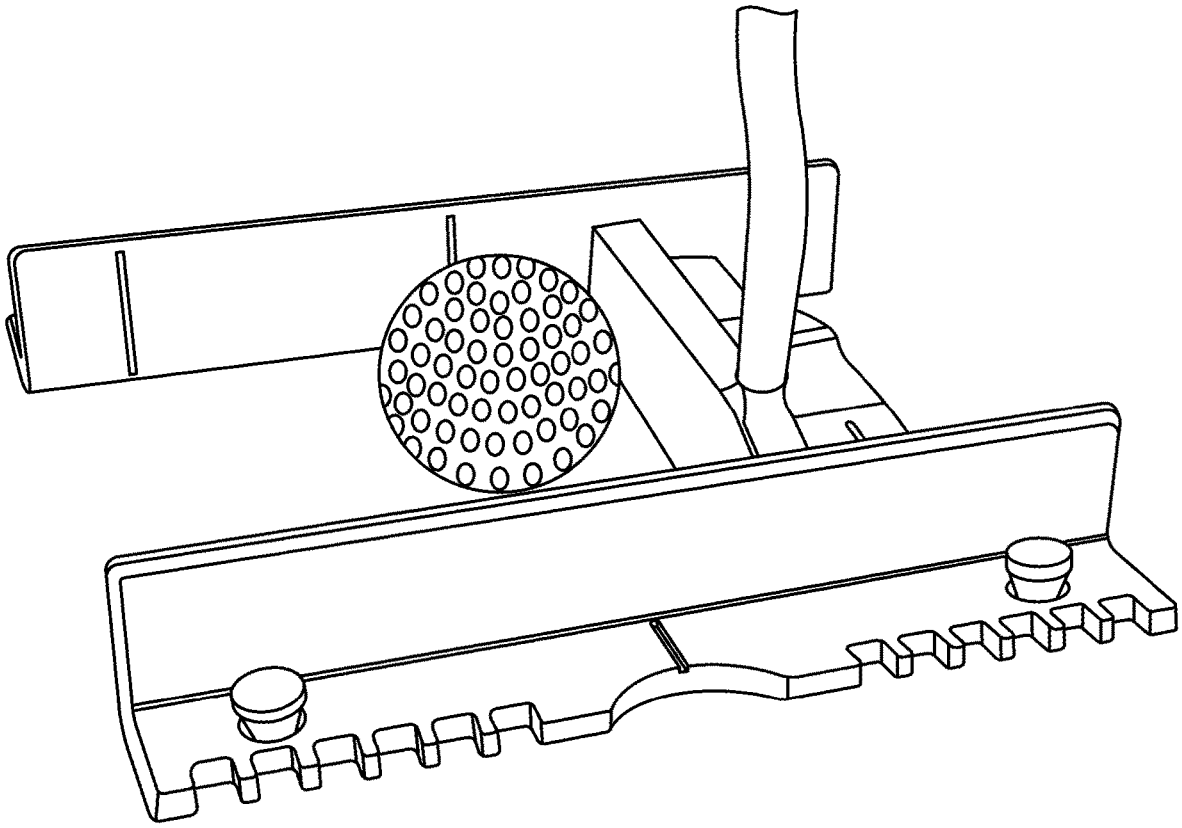
FIG. 29 shows two golf practice alignment tools with twelve notches marking a path for the golf ball.

Referring to FIG. 1, FIG. 2, FIG. 3, and FIG. 4, we show different views of a golf practice alignment tool 100, according to an embodiment of the invention. The golf practice alignment tool 100 has strategically placed tee holes (2), notches (3, 4), and markings that allow a golfer to align a golf shot to better hit a target during practice. A preferred embodiment of the tool 100 has a substantially "L" shaped profile, measuring approximately 150 to 200 mm in length, 20 to 50 mm in height, and 3 to 10 mm in thickness. One with knowledge in the art will appreciate that the measurements are examples only and are not intended to limit the invention to those exact measurements. For example, FIG. 29 shows a golf practice alignment tool with six notches on each side of a centerline, rather than the three notches shown in FIG. 1.

The material of the tool 100 and its coloring can vary based on consumer preference. For example, a high-end version of the tool may be machined from aircraft-grade aluminum, while a low-cost mass-market version may be injection molded using a durable plastic, such as Acrylonitrile Butadiene Styrene (ABS) or high quality polyamide (PA) plastic. A non-exhaustive list of materials includes: anodized aluminum, aluminum plate, high density polyethylene, nylon plastic, fiber reinforced plastic, brushed aluminum plate, polyvinyl chloride (PVC), ECO plastic, stainless steel, brushed stainless steel, recycled plastic aluminum, any biodegradable or recyclable material such as cardboard, any engineered wood product such as chipboard, or a combination of the foregoing. For marketing and branding purposes, the area 7 can be custom branded, or white labeled. The area 7 can be used to advertise specialty items. Area 7 can also be used to allow a golfer to personalize his practice tool 100 to distinguish it from others on the range.

The "L" shaped main side panel 1 has strategically placed markings 6 to create alignment when used with a golf ball and golf club. This allows the club to rest on its side or in between the path created by the tee placement. This creates a repeatable square swing through impact when sliding a club back and forth or through the intended line/path to target hole.

Figure 25:
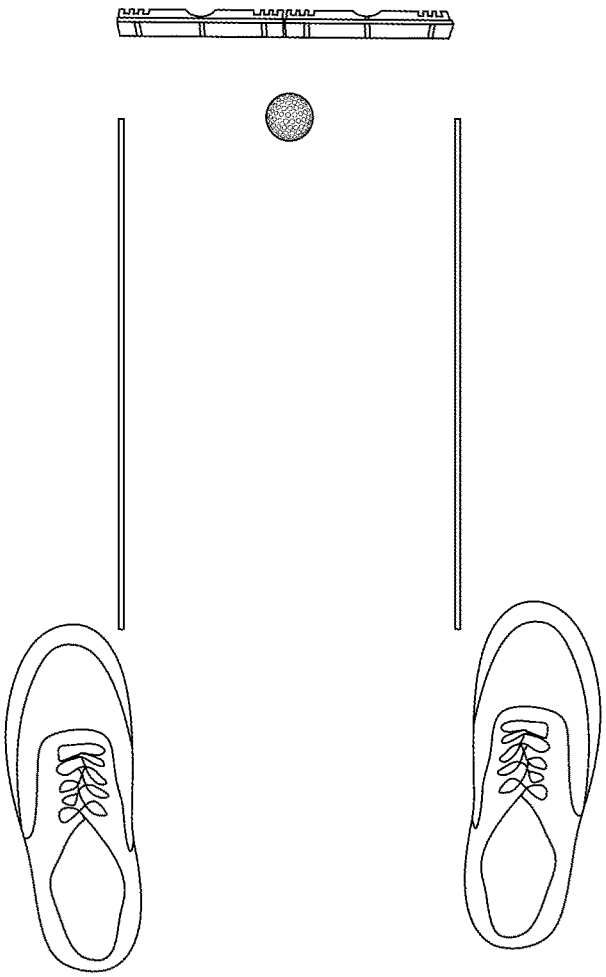
FIG. 25 shows an example of side-by-side placement of two golf practice alignment tools lining up to the width of a golf stance.
Figure 26:
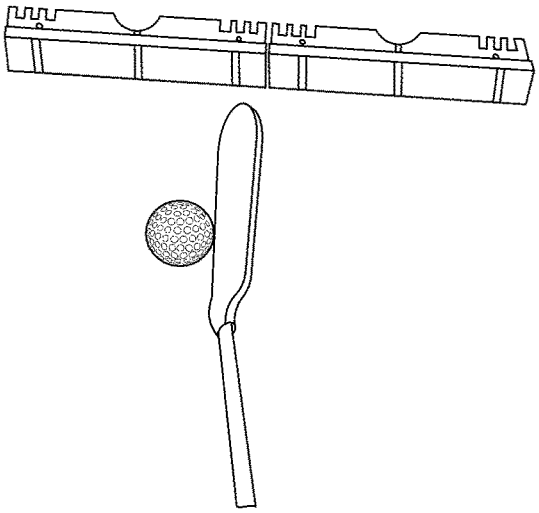
FIG. 26 shows the ball in relation to the markings.

Center marking 5 marks the golf club swing sweet spot area. The sweet spot indicates where the club is most square during a golf swing. Center marking 5 provides a visual indicator while swinging. Golf ball position indicators 6 mark the suggested area for ball placement in relation to a golf stance and setup, thus providing a visual indicator for a club's position during a swing. As shown in FIGS. 25 and 26, when two tools 100 are used side-by-side, the evenly-spaced golf ball position indicators 6 create a ruler effect that is used to help square clubs during driving range practice. The highly visible indicators 6 mark the suggested area where ball placement should be in relation to a golf stance and setup. The markings are designed to show up clearly in a video if the practice is recorded.

The tee holes 2 are used to temporarily pin down the tool 100 on any grass surface in a golf course, including putting surfaces, fairways and rough grass, thereby locking the tool 100 in place. As a non-limiting example, the tee holes 2 have a diameter of 6 mm to accommodate a standard golf tee.

The putter tee notches 3 accommodate all United States Golf Association (USGA) standard head putter tee sizes. The putter tee notches 3 are used to set up tee putting practice patterns with golf tees. They differ from the tee holes 2 in that the putter tee notches 3 are not meant to lock the tool 100 in place; rather they are used to set the placement of tees to create a path, after which the tool 100 is removed. The multiple putter tee notches 3 allow for different width placements for tees, allowing for multiple patterns to be created. As a non-limiting example, the tool 100 shown in the views of FIGS. 1 through 4 has six putter tee notches 3, with two notches each in outer, middle, and inner positions. FIG. 29 shows an embodiment with twelve putter tee notches. The golf ball notch center line 4 is used to set up a golf ball during a put. The center line 4 is used in conjunction with the setup for the tee putting patterns. The center line 4 is aligned to a break in the green for accuracy and precision during putting practice. It is contemplated as part of the present invention that embodiments thereof may employ various spacing schemes and corresponding markings as dictated by player level and type of golf shot.

Figure 28:
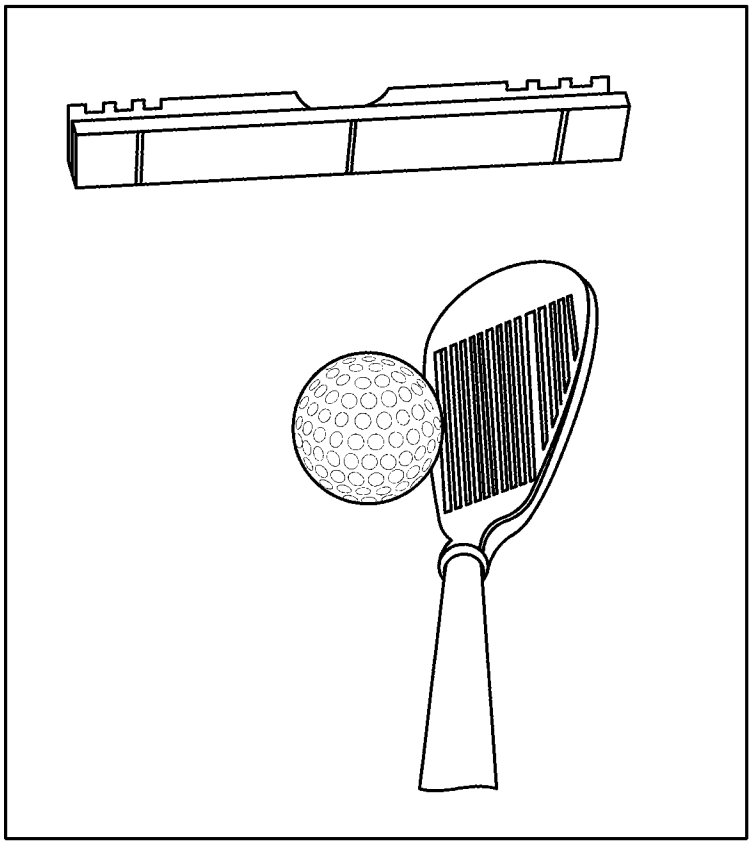
FIG. 28 shows one golf practice alignment tool marking placement for a pitch shot.

Whether you use one tool 100 or multiple tools during practice, a golfer can position the tool(s) 100 and keep the tool(s) on the green while practicing a short game. For example, referring to FIGS. 27, 28, and 29, a golfer aligns the tool(s) 100 to the desired landing line area to the target hole and positions his chipping and pitching club against the side panel 1, centering the golf ball to the center line 5.

Use Cases with One Golf Practice Alignment Tool

Figure 1:
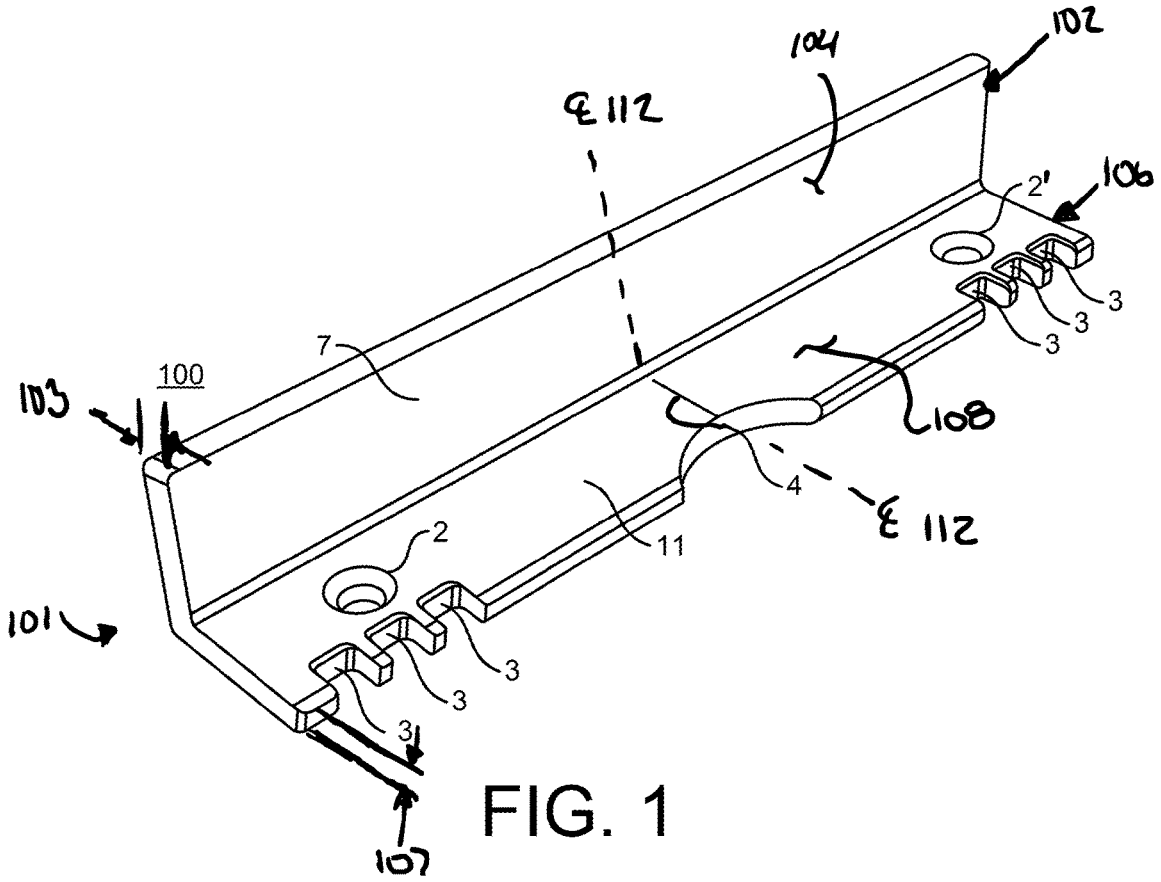
FIG. 1 shows an isometric front view of an embodiment of the present invention.
Figure 2:
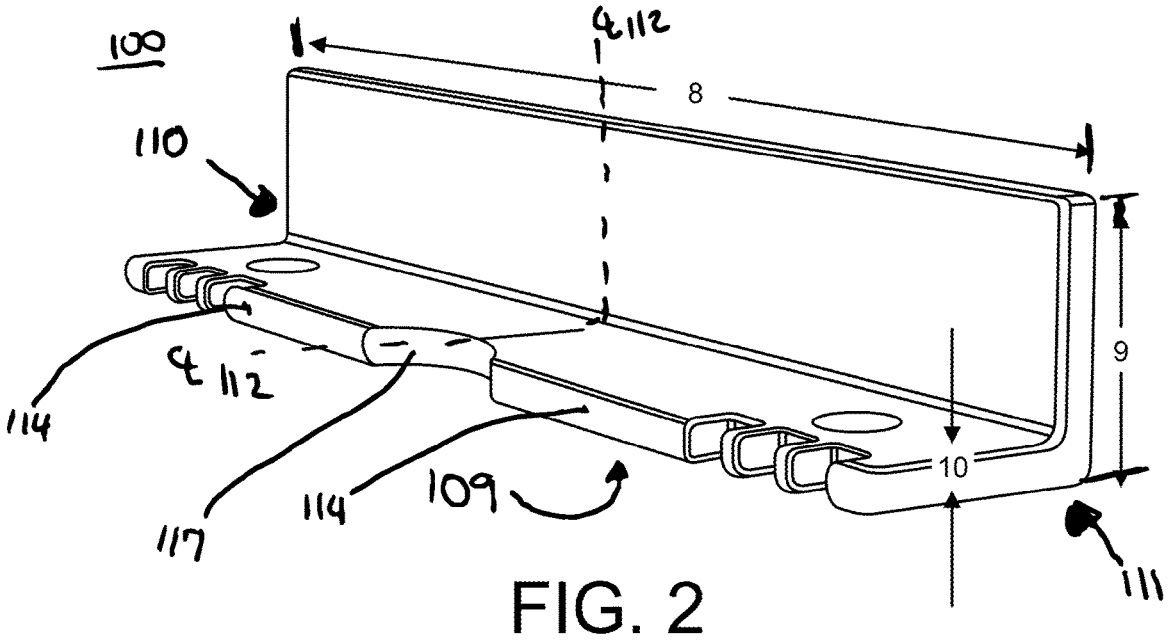
FIG. 2 shows another isometric front view of an embodiment of the present invention.
Figure 3:
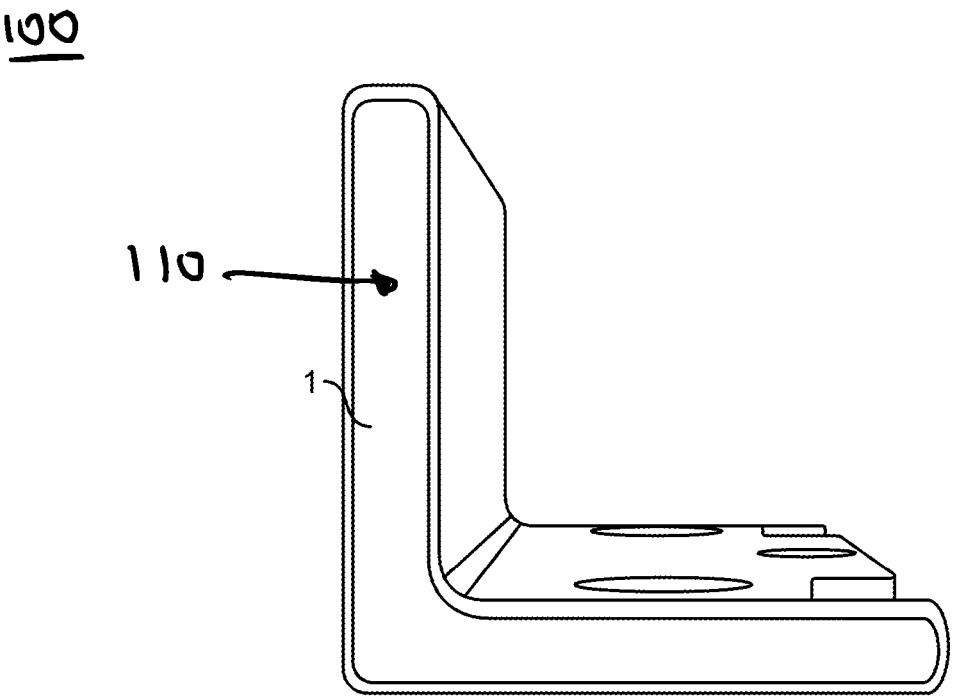
FIG. 3 shows a side view of an embodiment of the present invention.
Figure 4:
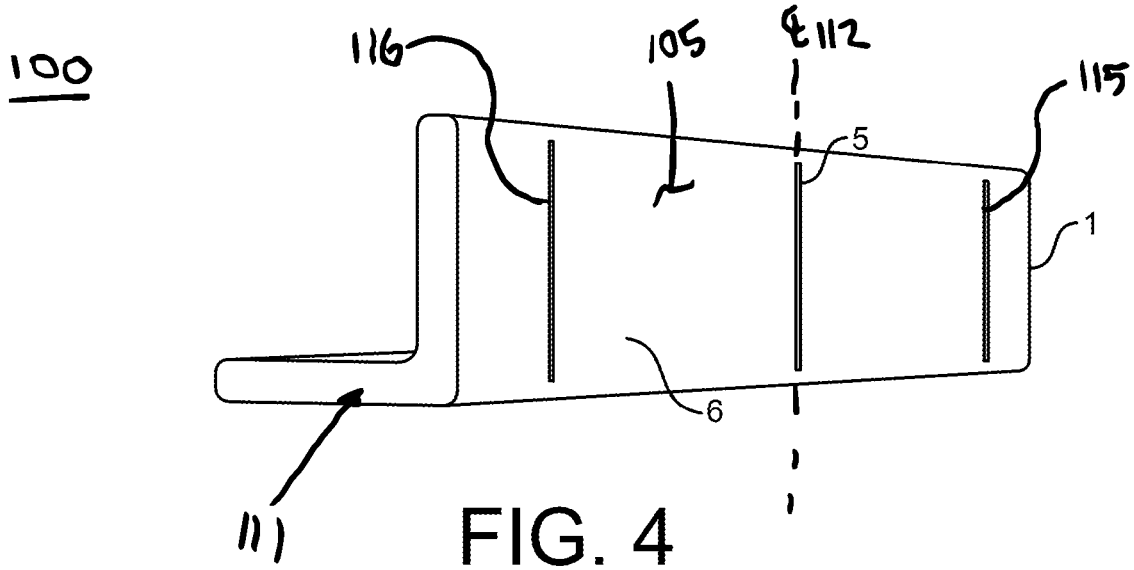
FIG. 4 shows an isometric back view of an embodiment of the present invention.
Figure 7:
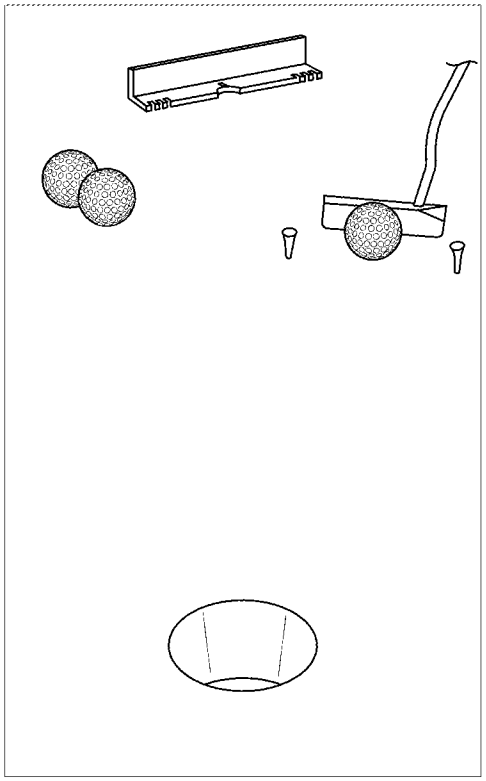
FIG. 7 shows the placement of the tees accommodating the width of the putter.
Figure 6:
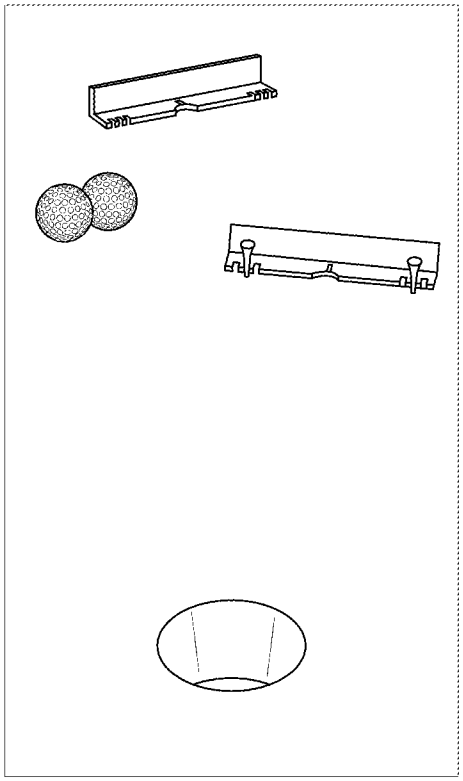
FIG. 6 shows placement of tees in the tee notches of the golf practice alignment tool, according to an embodiment of the invention.
Figure 5:
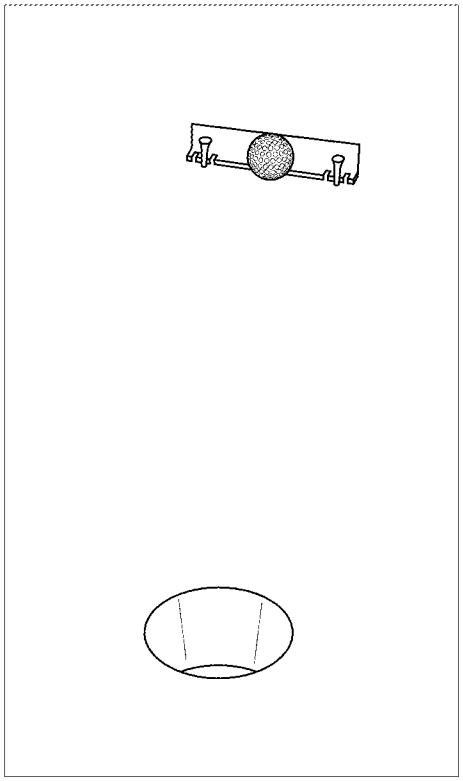
FIG. 5 shows alignment of a golf ball with the center line of the golf practice alignment tool, according to an embodiment of the invention.
Figure 9:
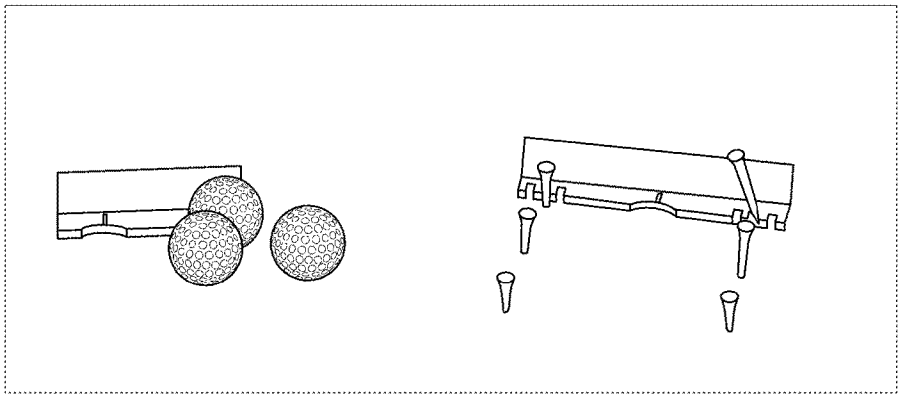
FIG. 9 shows the marking of a path with six tees, according to an embodiment of the invention.
Figure 11:
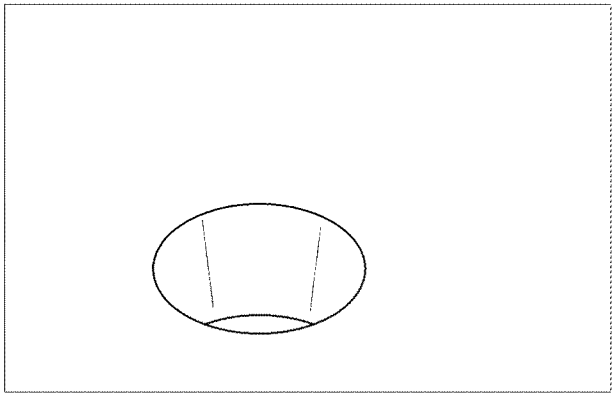
FIG. 11 shows the target hole used to align the path.
Figure 8:
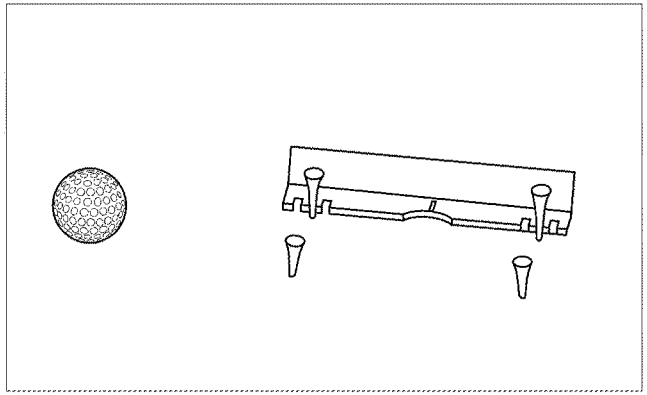
FIG. 8 shows the placement of tees to mark a path, according to an embodiment of the invention.
Figure 10:
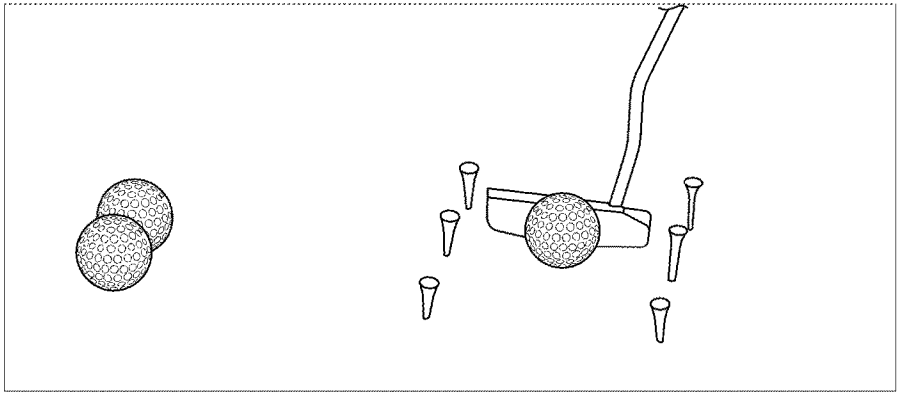
FIG. 10 shows the putter making contact with the golf ball in the path.

Referring now to FIGS. 5, 6, 7, 8, 9, and 10, with just one tool 100 a golfer can create multiple tee patterns for putting practice. The tees can be placed in accordance with the width of the putter. A golfer can position the tool 100 horizontally, pointing to a break and target hole (shown in FIG. 11). This allows the golfer to position the putter against the side panel 1 and center the golf ball and putter using the distinctive markings on the tool 100. This allows the golfer to feel the position and center of swing that best aligns to the center of the target hole. Using the standard tee holes 2 allows the golfer to position and lock the tool 100 in place with precise position to the target hole. Repeating the drill will help the golfer develop a more consistent putter swing; therefore creating more accurate putts to help lower a golf score.

Figure 14:
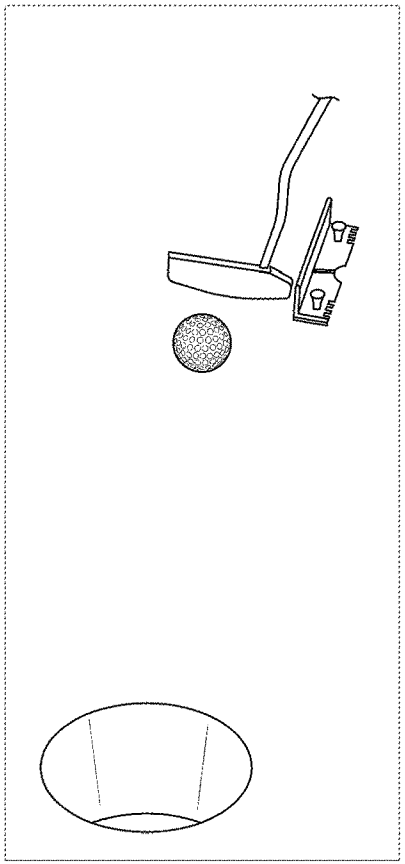
FIG. 14 shows the ball on course to the target hole.
Figure 13:
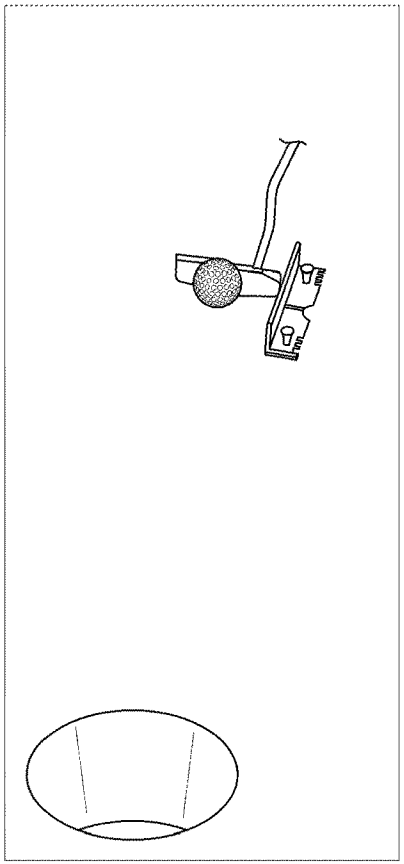
FIG. 13 shows another view of the horizontal alignment, according to an embodiment of the invention.
Figure 12:
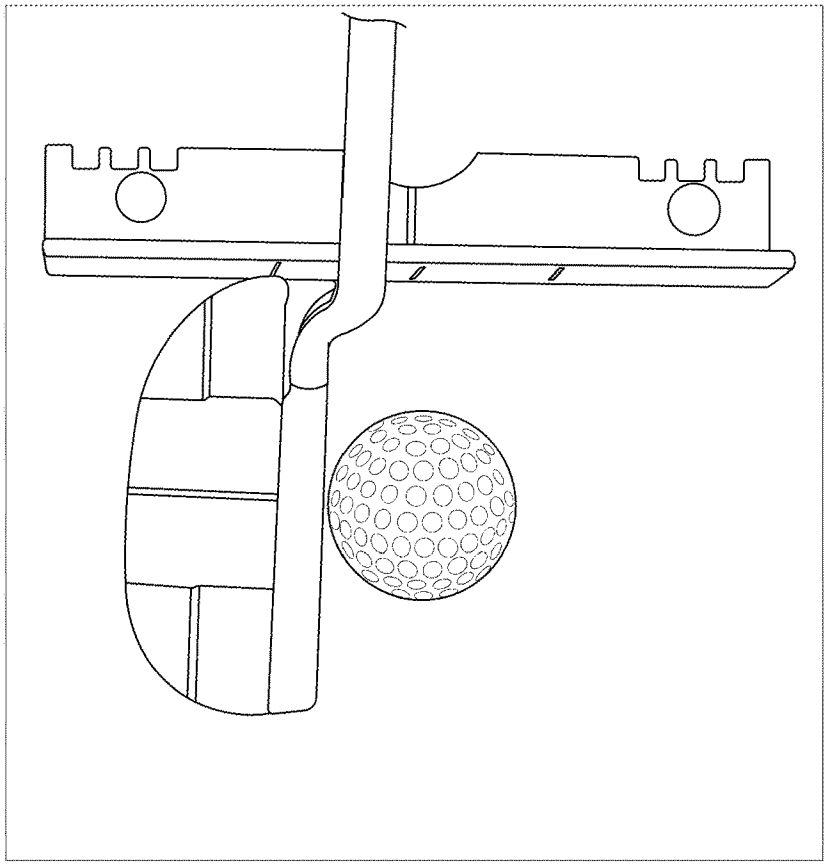
FIG. 12 shows the golf club heel position on the golf practice alignment tool, according to an embodiment of the invention.

Referring to FIGS. 12, 13, and 14, the golfer can position the tool 100 horizontally (perpendicular to the putter), pointing to the break and target hole. The golfer positions the putter against the side panel 1 and centers the golf ball using the distinctive lines on the tool 100. This allows the golfer to feel the position and center of a swing to best align to the center of the target hole. Using the standard tee holes 2 allows the golfer to position and lock the tool 100 in place with the precise position to the target hole. Repeating the drill helps develop a more consistent putter swing. More accurate putts lower the score.

When the tool 100 is placed on the green, the tees are inserted into the notches 3, one on each side, according to the width of the putter. The tool 100 allows the golfer to precisely align two tees or rows of tees to create the desired path for the ball. See FIGS. 8, 9, and 10.

Use Cases with Two Golf Alignment Tools

Placing two tools 100 side by side creates a rule-type measuring device that can be used to help square clubs during driving range practice. Lining up the tools 100 creates an imaginary center line at the center of both tools 100, allowing the golfer to square the club without interference. See FIGS. 25 and 26.

Figure 16:
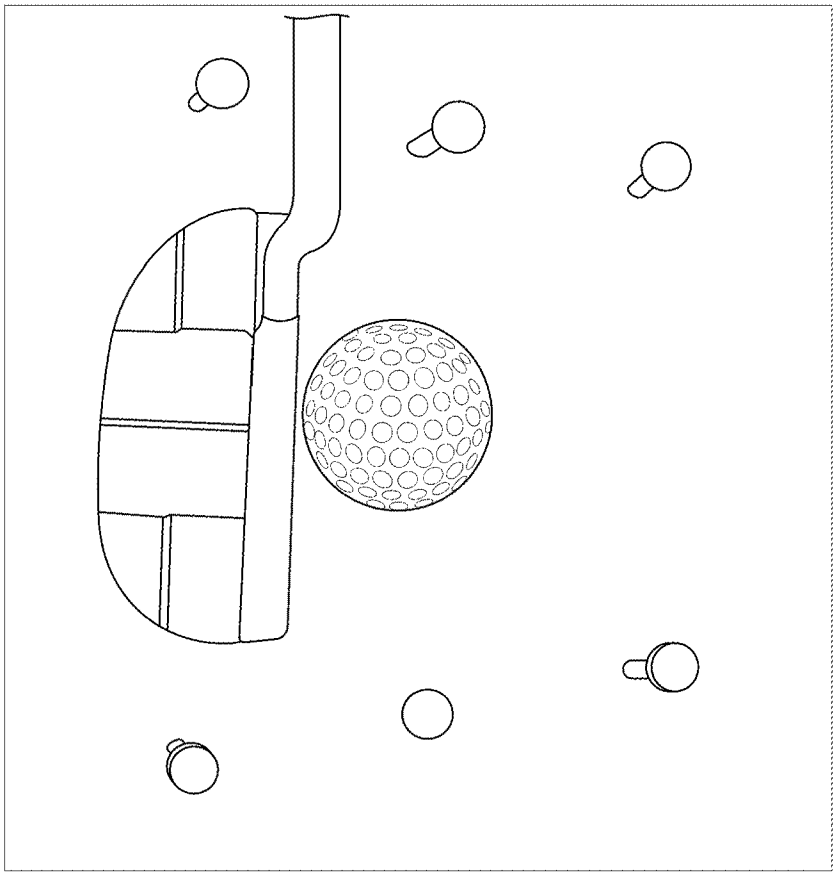
FIG. 16 shows the putter and golf ball in the funnel pattern.
Figure 15:
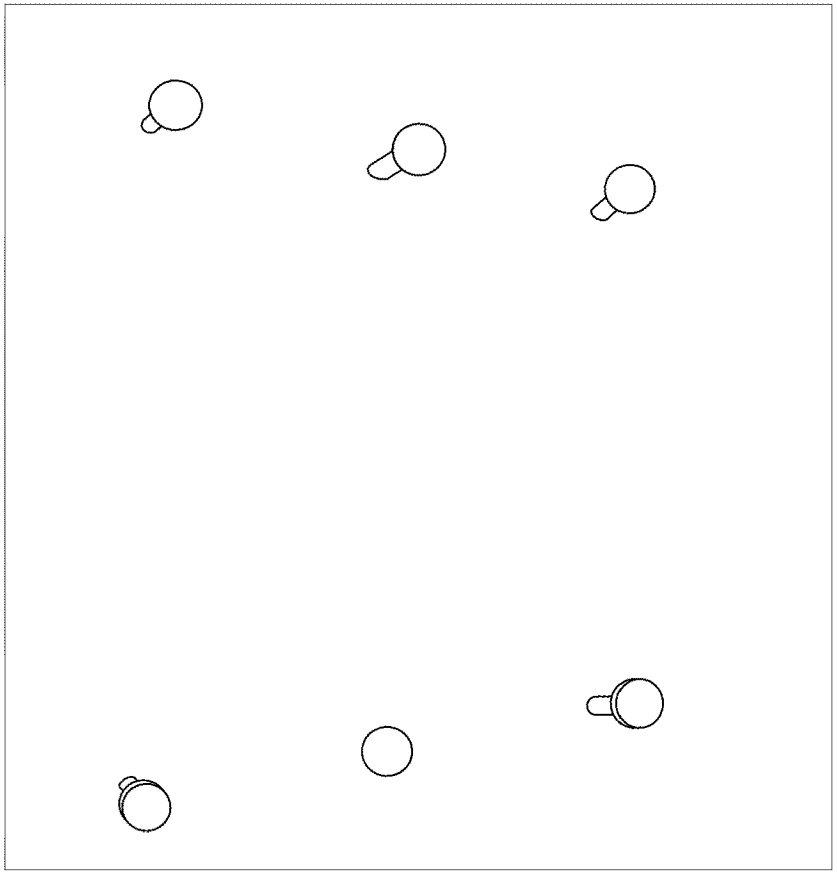
FIG. 15 shows the funnel pattern created by tee placement using the golf practice alignment tool.
Figure 19:
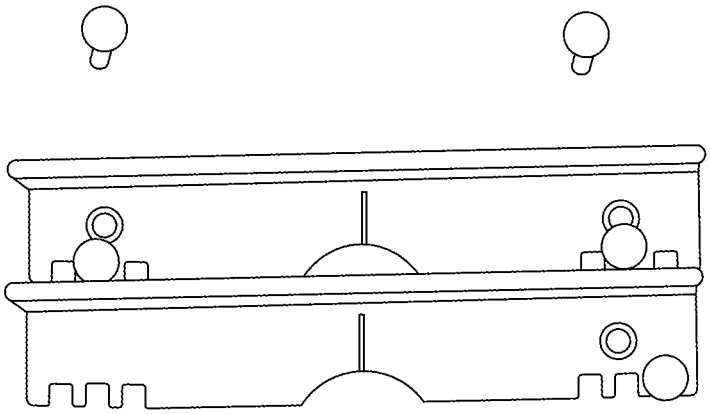
FIG. 19 shows placement of the third row of tees in the funnel pattern using the golf practice alignment tool, according to an embodiment of the invention.
Figure 18:
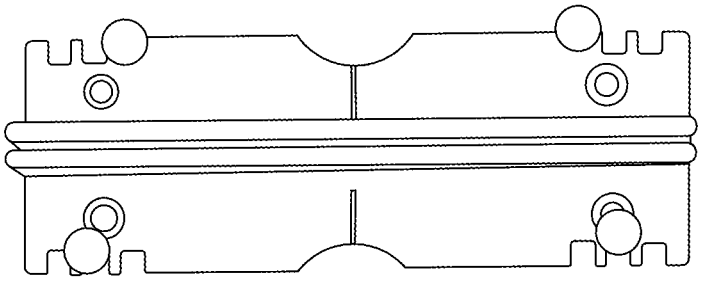
FIG. 18 shows the use of two golf practice alignment tools to align tees in a funnel pattern, according to an embodiment of the invention.
Figure 17:
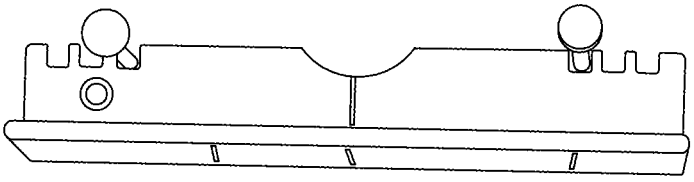
FIG. 17 shows placement of the tees in the inside tee holes of the golf practice alignment tool, according to an embodiment of the invention.
Figure 22:
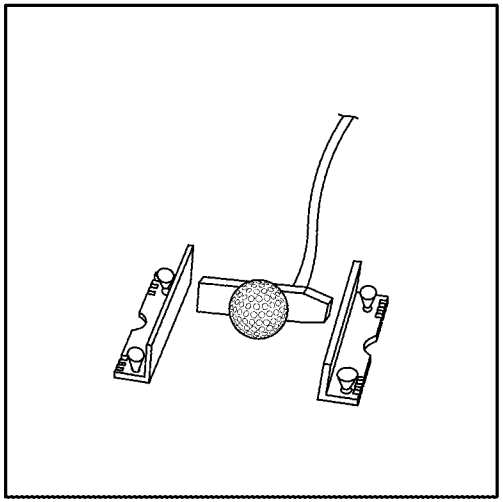
FIG. 22 shows how the width of the putter aligns with the path.
Figure 21:
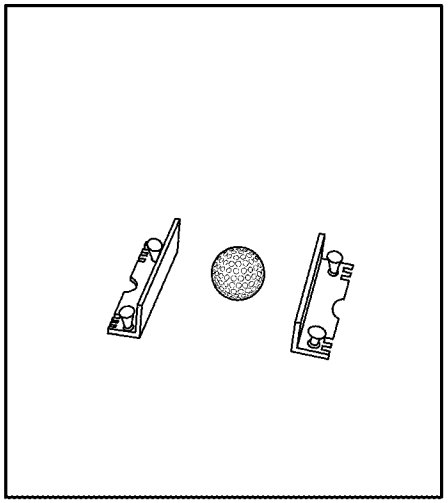
FIG. 21 shows the use of two golf practice alignment tools to mark a path for the golf ball, according to an embodiment of the invention.
Figure 20:
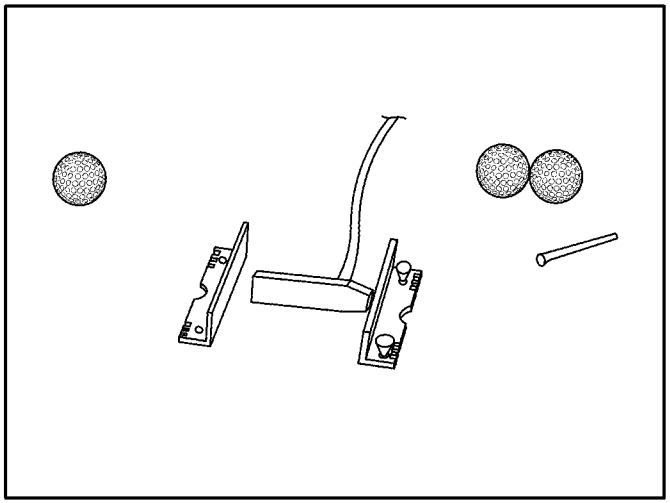
FIG. 20 shows placement of the golf practice alignment tool using a putter, according to an embodiment of the invention.
Figure 23:
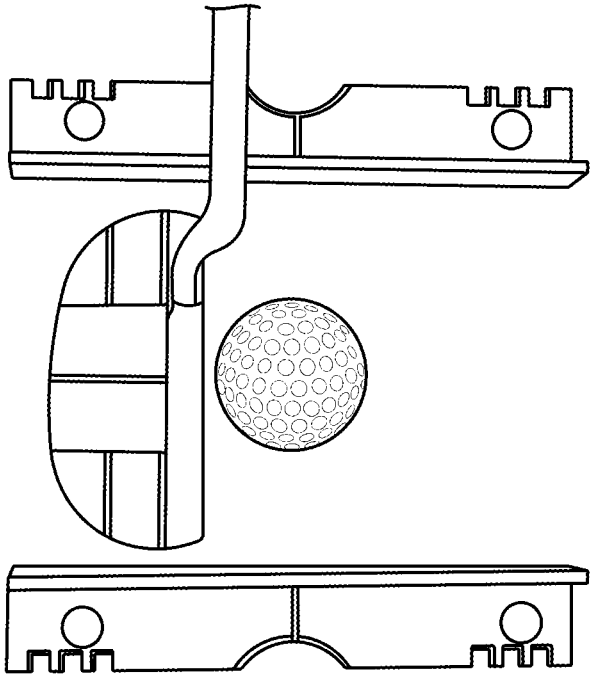
FIG. 23 is an overhead view of the two-tool placement.
Figure 24:
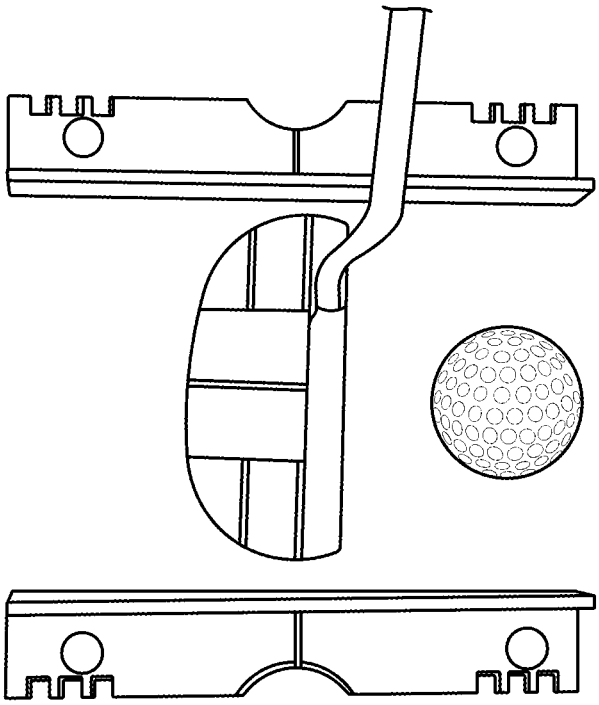
FIG. 24 is another overhead view of the two-tool placement.

FIGS. 17, 18, 19 illustrate how to use two tools 100 to create the funnel pattern shown in FIGS. 15 and 16 where the width of the tee placement narrows closer to the target hole. One row of tees is placed in the two outer tee notches 2, a second row is placed in the middle tee notches 2, and a third row is placed in the inner tee notches 2. Using two tools 100 a golfer is able to generate a putting path to align tees in a variety of patterns that help align the putter and swing to the target hole, using any golf tees.

Figure 27:
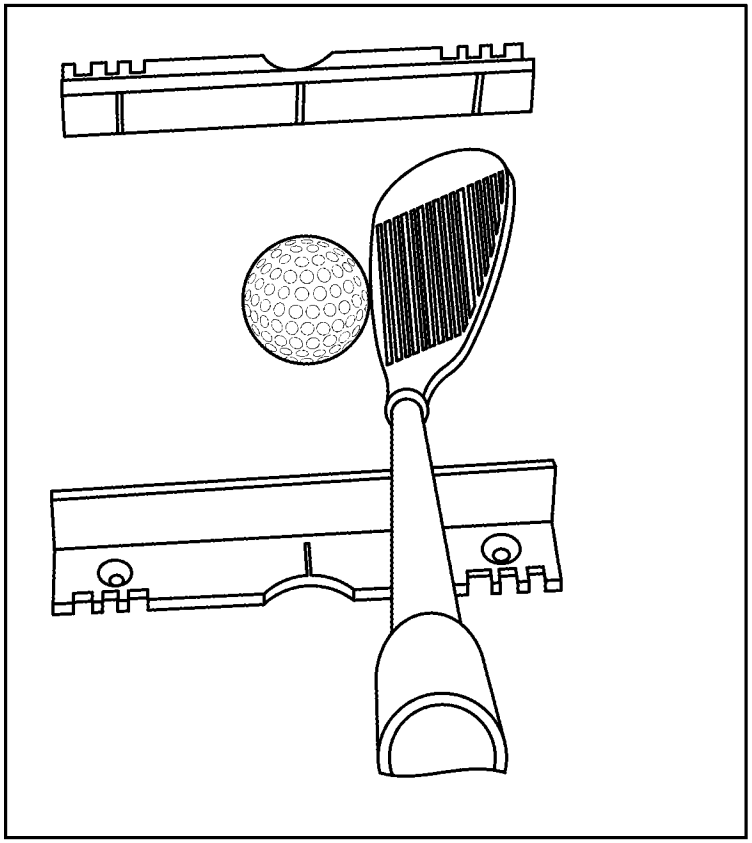
FIG. 27 shows two golf practice alignment tools lining up to the target line area for a chip shot.

As shown in FIGS. 27 and 29, using two tools 100 helps position the club within the path line at target. This helps create a more consistent short game swing. Repeating the drill helps develop a more consistent short game.

Application

A companion application (app) can be used to set up practice routines, track progress, and pin point areas of the game that need more improvement. The app can act as a digital instruction book, providing instructions and examples of how to position and use the tool 100 for different shots/goals.

In light of the foregoing description, it should be recognized that embodiments in accordance with the present invention can be realized in numerous configurations contemplated to be within the scope and spirit of the claims. Additionally, the description above is intended by way of example only and is not intended to limit the present invention in any way. Components or features from one embodiment can be used with another embodiment.

The invention claimed is:

1. An alignment tool comprising:

a substantially L-shaped protrusion having a first leg with a first thickness, a front, and a back, and a second leg, substantially orthogonally disposed relative to the first leg, with a second thickness, a top, and a bottom, where the substantially L-shaped protrusion has a proximal end, a distal end disposed at a length from the proximal end, and a center disposed at a distance approximately halfway between the distal end and the proximal end;

a first edge disposed on the first leg extending between the proximal end and the distal end, disposed opposite the second leg;

a second edge on the second leg extending between the proximal end and the distal end, disposed opposite the first leg;

a first centerline marking disposed on the back of the first leg, at the center of the protrusion, and perpendicular to the second leg; a proximal alignment marking is disposed on the back of the first leg, between the first centerline marking and the proximal end, and parallel to the first centerline marking;

a distal alignment marking is disposed on the back of the first leg, between the first centerline marking and the distal end, and parallel to the first centerline marking; a second centerline marking is disposed on the top of the second leg, at the center of the protrusion, and perpendicular to the first leg;

a first hole through the top of the second leg is disposed between the second centerline marking and the proximal end;

a second hole through the top of the second leg is disposed between the second centerline marking and the distal end;

at least one notch through the top of the second leg is disposed between the second centerline marking and the proximal end and open toward the second edge; and at least one notch through the top of the second leg is disposed between the second centerline marking and the distal end and open toward the second edge.

2. The alignment tool of claim 1 further comprising a semi-circular notch through the top of the second leg, centered with the second centerline marking and open towards the second edge.

3. The alignment tool of claim 2 further comprising an area disposed on the first leg.

* * * * *